US006309062B1

(12) United States Patent
Hickman et al.

(10) Patent No.: US 6,309,062 B1
(45) **Date of Patent: *Oct. 30, 2001**

(54) MULTI-CHAMBER FLUID SUPPLY

(75) Inventors: Mark S. Hickman, Vancouver, WA (US); Ronald A. Askeland, San Diego, CA (US)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/183,538

(22) Filed: Oct. 29, 1998

(51) Int. Cl.[7] ..... B41J 2/17
(52) U.S. Cl. ..... 347/96
(58) Field of Search ..... 347/96, 43, 98, 347/85, 95; 106/31.13, 31.27, 31.43, 31.51

(56) References Cited

U.S. PATENT DOCUMENTS

| | | | | |
|---|---|---|---|---|
| 3,349,408 | | 10/1967 | Gillen et al. | 346/112 |
| 4,438,191 | | 3/1984 | Cloutier et al. | 430/324 |
| 4,694,302 | | 9/1987 | Hackleman et al. | 347/96 |
| 4,849,770 | * | 7/1989 | Koike et al. | 347/100 |
| 4,922,265 | | 5/1990 | Pan | 347/47 |
| 4,963,189 | | 10/1990 | Hindagolla | 106/31.52 |
| 5,085,698 | | 2/1992 | Ma et al. | 524/388 |
| 5,181,045 | | 1/1993 | Shields et al. | 347/43 |
| 5,428,383 | | 6/1995 | Shields et al. | 347/96 |
| 5,488,402 | * | 1/1996 | Shields et al. | 347/96 |
| 5,549,740 | | 8/1996 | Takahashi et al. | 106/31.43 |
| 5,555,008 | | 9/1996 | Stoffel et al. | 347/100 |
| 5,635,969 | | 6/1997 | Allen | 347/96 |
| 5,640,187 | | 6/1997 | Kashiwazaki et al. | 367/101 |
| 5,679,143 | | 10/1997 | Looman | 106/31.43 |
| 5,696,820 | | 12/1997 | Davis et al. | 427/261 |
| 5,723,179 | | 3/1998 | Wong et al. | 427/258 |
| 5,746,818 | * | 5/1998 | Yatake | 106/31.86 |
| 5,785,743 | | 7/1998 | Adamic et al. | 106/31.27 |
| 5,785,783 | * | 7/1998 | Adamic et al. | 106/31.27 |
| 5,792,249 | | 8/1998 | Shirota et al. | 106/31.27 |
| 5,976,230 | * | 11/1999 | Askeland et al. | 106/31.27 |
| 6,022,908 | * | 2/2000 | Ma et al. | 523/160 |
| 6,126,268 | * | 10/2000 | Askeland et al. | 347/43 |

FOREIGN PATENT DOCUMENTS

| | | |
|---|---|---|
| 0 268 237A | 5/1988 | (EP) . |
| 0 726 158A | 8/1996 | (EP) . |

* cited by examiner

*Primary Examiner*—N. Le
*Assistant Examiner*—Michael Nghiem

(57) ABSTRACT

In accordance with the invention, an ink-jet printing system and fluid supply configuration are disclosed that utilize the advantages of reactive fluids while allowing for maximum flexibility in the design and architecture of the ink-jet printing system. The ink-jet-printing apparatus includes a printhead portion having at least one integral printhead portion, the printhead portion having at least two ejector portions; and at least one reservoir portion associated with the printhead portion, the reservoir portion having at least two reservoir chambers, each reservoir chamber for providing fluid to one of the at least two ejector portions, one of the chambers including a reactant fluid and the other chamber including at least one ink non-reactive with the reactant fluid.

33 Claims, 9 Drawing Sheets

MULTI-CHAMBER FLUID SUPPLY

CROSS REFERENCE TO RELATED APPLICATIONS

The present application is a continuation in part of U.S. application Ser. No. 09/069,717 entitled "Reactive Ink Set For Ink-Jet Printing," by Askeland et al., filed Apr. 29, 1998 now U.S. Pat. No. 5,976,230; and is also a continuation in part of U.S. application Ser. No. 09/069,616 entitled "Multi-Chamber Ink Supply," by Askeland et al., filed Apr. 29, 1998 now U.S. Pat. No. 6,126,268; all assigned to same assignee as the present invention.

FIELD OF INVENTION

This invention relates to ink-jet printers and the like and, more particularly, to a compact and high print speed ink-jet printing system having enhanced performance.

BACKGROUND OF THE INVENTION

Ink-jet printing is a non-impact printing process in which droplets of ink are deposited on a print medium in a particular order to form alphanumeric characters, area-fills, and other patterns thereon. Low cost and high quality of the hardcopy output, combined with relatively noise-free operation, have made ink-jet printers a popular alternative to other types of printers used with computers.

The non-impact printing process of ink-jet printing involves the ejection of fine droplets of ink onto a print medium such as paper, transparency film, or textiles in response to electrical signals generated by a microprocessor. There are two basic means currently available for achieving ink droplet ejection in inkjet printing: thermally and piezoelectrically. In piezoelectric ink-jet printing, the ink droplets are ejected due to the vibrations of piezoelectric crystals, again, in response to electrical signals generated by the microprocessor.

In thermal ink-jet printing, an ink-jet image is formed when a precise pattern of dots is ejected from a drop generating device known as a "printhead" onto a printing medium. The typical ink-jet printhead has an array of precisely formed nozzles (or ejector portions) attached to a thermal ink-jet printhead substrate, such as silicon, nickel, or polyimide, or a combination thereof The substrate incorporates an array of firing chambers or drop ejector portions that receive liquid ink (colorants dissolved or dispersed in a solvent) through fluid communication with one or more ink reservoir. Each firing chamber has a thin-film resistor, known as a "firing resistor," located opposite the nozzle so ink can collect between the firing resistor and the nozzle. The printhead is mounted on a carriage that travels along the width of the printer (otherwise referred to as the "scan axis").

Commercially-available thermal ink-jet printers, such as DeskJet® printers available from Hewlett-Packard Company, use inks of differing hues, namely, magenta, yellow, and cyan, and optionally black. The particular set of colorants, e.g., dyes, used to make the inks is called a "primary dye set." A spectrum of colors, e.g., secondary colors, can be generated using different combinations of the primary dye set.

One category of ink-jet printers utilizes disposable printheads in which the ink reservoirs are on-board the carriage, thus the term on-board or on-axis. The reservoirs can be formed integrally with the printhead portions or they can be detachably connected thereto.

Another category of ink-jet printers employs ink reservoirs that are not located on the carriage, thus the term off-board or off-axis. In one case, the reservoir intermittently replenishes the printhead with ink when the printhead travels to a stationary reservoir periodically for replenishment. Another type makes use of a replaceable ink reservoir connected to the printhead by a fluid conduit. The printhead is replenished with ink through this fluid conduit.

The reservoirs may be individually (separate from other reservoirs) replaceable or the reservoirs can be formed as one integral reservoir portion, to be replaced as a unit.

Different printhead/ink reservoir configurations address different customer needs. For example, on-board designs provide for ease of use. Printers using the off-board designs provide for fewer interruptions during printing jobs which require larger ink volumes, such as large format printing.

In general, a successful ink set for color ink-jet printing should have the following properties: good crusting resistance, good stability, the proper viscosity, the proper surface tension, good color-to-color bleed alleviation, vibrant colors, sharp edges, rapid dry time, no negative reaction with the vehicle, consumer-safety, good permanence (e.g., smearfastness, lightfastness, waterfastness), and low strike-through. When placed into a thermal ink-jet system, the ink set should also be kogation-resistant.

Regardless of whether an ink is dye-based or pigment-based, ink-jet inks commonly face the challenge of color-to-color or black-to-color bleed control. The term "bleed," as used herein, is defined to be the invasion of one color into another, once the ink is deposited on the print medium, as evidenced by a ragged border therebetween. Bleed occurs as colors mix both on the surface of the paper substrate as well as within the substrate itself. The occurrence of bleed is especially problematic between a black ink and an adjacently-printed color ink because it is all the more visible. Hence, to achieve good print quality, bleed should be substantially reduced or eliminated such that borders between colors are clean and free from the invasion of one color into the other. Several approaches have been utilized in controlling bleed between the printed images, many of which utilize reactive ink mechanisms.

One approach used for controlling bleed between the printed images, as disclosed in U.S. Pat. No. 5,428,383, entitled "Method and Apparatus for Preventing Color Bleed in a Multi-Ink Printing System," filed by Shields et al., and assigned to the same assignee as the present invention, and incorporated herein by reference, is to employ a precipitating agent (e.g., a multi-valent metal salt) in one ink, and a colorant, preferably in the form of an organic dye having at least one and preferably two or more carboxyl and/or carboxylate groups, in another ink, preferably the black ink. When the inks are printed on the printing medium adjacent one another, the ink containing the precipitating agent brings about the precipitation of the colorant with the carboxyl/carboxylate group, thereby preventing the migration of the colorant in the other ink, thereby reducing bleed between the two adjacently printed areas.

Another method of reducing bleed between ink-jet inks involves the use of pH-sensitive dyes as disclosed in U.S. Pat. No. 5,181,045 entitled "Bleed Alleviation Using pH-sensitive Dyes/Inks," filed by Shields et al, and assigned to the same assignee as the present invention, and incorporated herein by reference. It disclosed therein that an ink having a pH-sensitive dye, the "pH-sensitive ink," would be prevented from bleeding into an adjacent ink having an appropriate pH, the "target ink." More particularly, migration of the ink having the pH-sensitive dye is prevented by rendering the dye insoluble on the page by contact with the adjacent ink having the appropriate pH. Thus, bleed is reduced or eliminated by using both the "pH-sensitive" ink as well as the "target" ink. Typically, since the invasion of a black dye into a color ink is more problematic than vice versa because of its greater visibility, the black ink would employ the pH-sensitive dye and the pH of the color ink would be controlled in the practice of the invention, such that the black ink would be prevented from bleeding into the color ink. The method of U.S. Pat. No. 5,181,045 requires a pH differential of about 4 (or even 5) units to completely control bleed.

U.S. Pat. No. 5,785,743 entitled "Bleed Alleviation in Ink-Jet Inks using Organic Acids," filed by Adamic et al. on Dec. 6, 1995, and assigned to the same assignee as the present invention) and U.S. Pat. No. 5,679,143 (entitled "Bleed Alleviation in Ink-jet Inks Using Acids Containing a Basic Functional Group," filed by Looman and assigned to the same assignee as the present invention), both incorporated herein by reference, further disclose methods for controlling bleed by forcing the precipitation of a pH-sensitive dye in one ink (the pH-sensitive ink) on the print medium by contacting the pH-sensitive dye with a second ink (the target ink) having an appropriate pH (either higher or lower than the first ink). Upon contact on the print medium, the pH-sensitive dye of the first ink becomes insoluble, thus bleeding less. U.S. application Ser. No. 08/567,974, now U.S. Pat. No. 5,785,743, discloses the use of organic acids to reduce the pH differential required to effect precipitation of a pH-sensitive dye colorant as compared to that disclosed in U.S. Pat. No. 5,181,045, described above. U.S. Pat. No. 5,679,143 employs the use of an organic acid having no basic functional groups and a pH adjusting organic compound containing both acidic and basic functional groups, specifically, at least one acidic functional group and at least one basic functional group, where the number of basic functional groups is the same as or greater than the number of acidic functional groups. The presence of the organic acid in the ink-jet ink composition reduces the pH differential required to render insoluble the pH-sensitive colorant of a second encroaching ink-jet ink composition, as described in U.S. application Ser. No. 08/567,974, now U.S. Pat. No. 5,785,743, above. The presence of the dual-function pH adjusting compound further increases the concentration of an acid functional group in the inkjet ink composition while also increasing the pH of the ink-jet ink composition to acceptable levels. Therefore, the dual-function pH adjusting compound augments the bleed alleviation achieved by an organic acid alone according to the mechanism disclosed in Ser. No. 08/567,974 now U.S. Pat. No. 5,785,743.

In order to prevent the occurrence of bleed between the primary (e.g., cyan, magenta, and yellow) and secondary colors (e.g., red, blue, and green) with black, all the three primary colors are designed to be reactive with the black ink according to reaction mechanisms such as those described above (multi-valent metal salt, pH-sensitive dye).

The above solutions utilizing reactive inks, although of merit, do not maximize flexibility in the design of the inks and printing system in which they are used. For example, using reactive ink systems may lead to unwanted mixing of the reactive inks, hence contributing to reliability problems in the printing system, particularly in compact printhead arrangements or compact ink delivery arrangements.

U.S. patent application Ser. No. 09/069,717 entitled "Reactive Ink Set For Ink-Jet Printing," filed Apr. 29, 1998 now U.S. Pat. No. 5,976,230, by Askeland et al., discloses an ink set and method for printing using the same, wherein the ink set comprises inks comprising an aqueous vehicle and a colorant, the ink set comprising at least two mutually reactive inks; and an ink non-reactive with the at least two mutually reactive inks. The ink set utilizes the advantages of reactive inks while allowing flexibility in the design of the inks and the architecture of the ink-jet printing systems in which they are used.

U.S. patent application Ser. No. 09/069,616 entitled "Multi-Chamber Ink Supply," filed Apr. 29, 1998 now U.S. Pat. No. 6,126,268, by Askeland et al., discloses, an ink-jet printing system and ink supply configuration that can utilize the advantages of reactive inks while allowing for maximum flexibility in the design and architecture of the ink-jet printing system. The ink-jet printing apparatus comprises a printhead portion having at least three ejector portions; a reservoir portion comprising at least three ink chambers, each ink chamber for providing ink to one of the at least three ejector portions, two of the ink chambers each chamber including one of a first or a second mutually reactive inks and the other ink chamber including an ink non-reactive with the first and second mutually reactive inks.

U.S. patent application Ser. No. 09/069,717 now U.S. Pat. No. 5,976,230 and Ser. No. 09/069,616 now U.S. Pat. No. 6,126,268, address either or both the undesirable mixing of colors (e.g., bleed) and other image quality attributes. When the ink set includes an ink non-reactive with the first ink, a printing method (the under-printing method) may be employed to reduce bleed between the first ink and the non-reactive ink or to enhance other print system attributes. In applying the "under-printing" method, an area (herein referred to as the first area) to be printed with the first ink (e.g., black) is also, at least partially, printed with at least one ink reactive (e.g., magenta or yellow) with the first ink, thereby minimizing the mixing of colors between the first area and a second area to be printed with the non-reactive ink. These ink sets comprising a non-reactive ink subset, although of great merit, do not address obtaining all of the image quality attribute enhancements desirable in an ink-jet image.

Therefore, a need exists for an ink-jet printing system and ink supply configuration that can utilize the advantages of reactive inks while allowing for maximum flexibility in the design and architecture of the ink-jet printing system.

DISCLOSURE OF THE INVENTION

In accordance with the invention, an ink-jet printing system and fluid supply configuration are disclosed that utilize the advantages of reactive fluids while allowing for maximum flexibility in the design and architecture of the ink-jet printing system. The ink-jet printing apparatus comprises a printhead portion having at least one integral printhead portion, the printhead portion having at least two ejector portions; and at least one reservoir portion associated with the printhead portion, the reservoir portion having at least two reservoir chambers, each reservoir chamber for providing fluid to one of the at least two ejector portions, one of the chambers including a reactant fluid and the other chamber including at least one ink non-reactive with the reactant fluid.

Additionally, in accordance with the invention, a fluid delivery apparatus for providing fluid to an ink-jet printing system is disclosed, the fluid delivery apparatus comprises a reservoir portion having at least one integral reservoir portion, the reservoir portion having at least two reservoir chambers, each reservoir chamber for providing fluid to the ink-jet printing system, one of the reservoir chambers including a reactant fluid, the other reservoir chambers including an ink non-reactive with the reactant fluid.

BRIEF DESCRIPTION OF THE DRAWINGS

FIG. 3(*b*) is an unscaled schematic, partially sectioned, representation of another ink-jet printhead with multiple integral printheads.

FIG. 3(*c*) is a unscaled schematic, partially sectioned, representation of another ink-jet printhead with multiple integral printheads.

FIG. 3(*d*) is an unscaled schematic, partially sectioned, representation of another ink-jet printhead with multiple integral printheads.

FIG. 3(*e*) is an unscaled schematic, partially sectioned, representation of another ink-jet printhead with multiple integral printheads.

DETAILED DESCRIPTION OF THE INVENTION

Definitions

Figure 1:
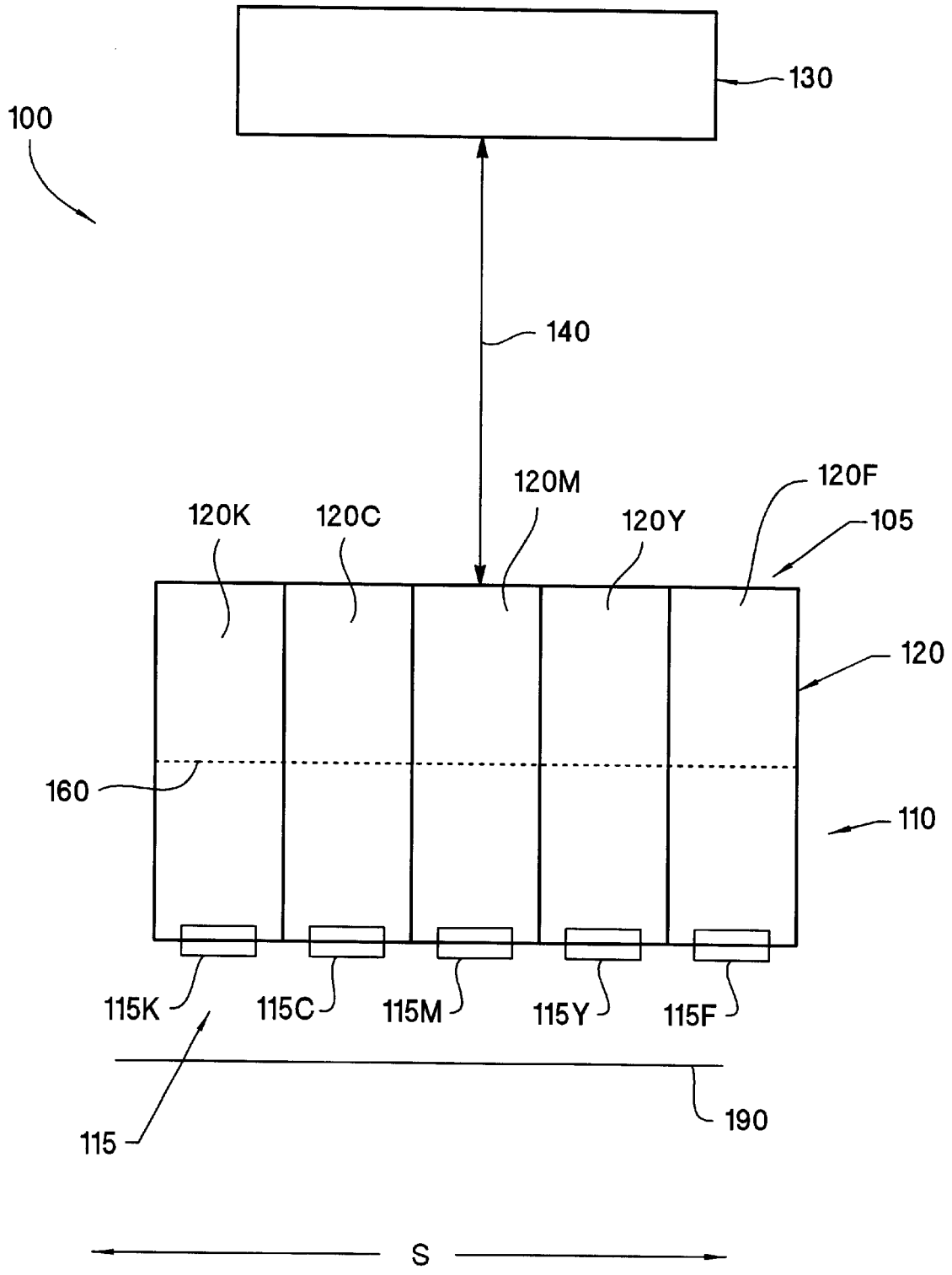
FIG. 1 is an unscaled schematic representation of an ink-jet printing system depicting an ink-jet printhead, fluid reservoir, and the control electronics.

Fluid—Includes either or both the reactant fluid and ink compositions.

Reaction—when the solubility or state of one or more colorants in at least one of two fluids reactive with one another, is changed as to immobilize the movement of the at least one colorant on the print medium in the event that the fluids come in contact with one another.

Reactant fluid—A fluid that is substantially devoid of color (i.e., the reactant fluid may contain no colorant (e.g., dye or pigment) at all, or it may contain a colorant that does not absorb in the visible light but may absorb in either or both IR or UV). The reactant fluid comprises a component (a molecule or complex, or a functional group in a molecule or complex) that is reactive with a component (a molecule or complex, or a functional group in a molecule or complex) in an ink thus providing for enhanced image integrity of printed areas created with the ink, such as, increased permanence (e.g. waterfastness, smearfastmess) or bleed alleviation; improved color vibrancy, improved edge acuity, or reduced dry time; in the event that the reactant fluid and the ink are printed at least partially on a same pre-determined area on a print medium, or on pre-determined areas adjacent one another on a print medium.

Reactive fluid—a fluid that is reactive with another fluid.

Mutually reactive fluid—Fluids reactive with one another.

Integral Printhead—A printhead having an array of drop ejector portions that are permanently attached to a rigid structure. Ejector portions are fabricated from materials including silicon, nickel, polyimide, or a combination thereof. Such techniques of forming a monolithic printhead are known in the art and are discussed in publication such as U.S. Pat. Nos. 4,438,191 and 4,922,265, both assigned to the assignee of the present invention.

Printhead Portion—A printhead comprising one or more integral printhead portions.

Integral Reservoir Portion—A reservoir portion comprising a plurality of reservoir chambers wherein the plurality of reservoir chambers are permanently affixed with respect to each other.

Integral Print Cartridge—An ink jet printhead portion; and at least one reservoir chamber, or an integral reservoir portion; forming an integral print cartridge.

On-board (on-axis)—A category of ink-jet printers utilizing disposable printheads in which the fluid reservoirs are on-board the carriage. The reservoirs can be formed integrally with the printhead portions or detachably connected thereto.

Off-board (off-axis)—A category of ink-jet printers employing fluid reservoirs that are not located on the carriage. In one case, the reservoir intermittently replenishes the printhead with fluid when the printhead travels to a stationary reservoir periodically for replenishment. Another type makes use of a replaceable ink reservoir connected to the printhead by a fluid conduit. The printhead is replenished with fluid through this fluid conduit.

Scan axis—Axis defined by motion of a carriage associated with the printing system.

Description

Referring now to FIG. 1, set forth therein is an unscaled schematic representation of an ink-jet printing system 100 which includes a multi color ink delivery system 105 of the present invention employing at least two fluids, the fluids including a reactant fluid and an ink non-reactive with the reactant fluid. The fluids may furthermore include at least one ink reactive with the reactant fluid for enhancing any one of a number of print system attributes such as bleed alleviation, smearfastness, reduced dry time. Printing system 100 includes a printhead portion 110 that receives signals from printing system control electronics 130 via electronic link 140 for selectively depositing droplets of fluid available from an fluid reservoir portion 120 on a printing medium 190 in response.

The printhead 110 comprises a plurality of ejector portions 115 for ejecting different fluids. In an exemplary embodiment, the ejector portion 115 comprises ejector portions 115K, 1115C, 115M, 115Y, and 115F for ejecting black, cyan, magenta, and yellow inks, and reactant fluid, respectively. However, more or less inks and reactant fluids can be utilized, having same or different formulations depending on the printing application and degree of print quality, color gamut, and other print attributes desired.

Each ejector portion receives fluid from a separate reservoir chamber (although in some embodiments it is possible to have more than one reservoir chamber including for supplying the same fluid to an ejector portion). In an exemplary embodiment, the reservoir portion 120 includes reservoir chambers 120K, 120C, 120M, and 120Y for housing black, cyan, magenta, and yellow inks, and 120F for housing reactant fluid "F", respectively. The reservoir chambers can be formed integrally with the printhead portion 110; or can be detachably connected to the printhead portion, either as in the case of an off-board or an on-board system. For example, there may be an optional separation portion 160 between the reservoir portion and the printhead portion. Each reservoir chamber may be individually replaceable. In a preferred embodiment, to simplify the fluid delivery system, the reservoir chambers are formed as one integral reservoir portion 120, to be replaced as a unit (i.e., integral reservoir portion).

In a preferred embodiment, the plurality of ejector portions 115, are arranged along an axis to simplify and maximize space efficiency. This axis will be referred to as the array axis "A." To further maximize space efficiency, the array axis "A" is parallel to a scan axis "S" referring to the direction of travel for the printhead portion over the printing medium during a printing operation.

In the remainder of the disclosure, by way of example, unless stated otherwise, "image integrity" will be used to describe the desired effect obtained as the result of the reaction between reactive fluids, for example between an ink reactive with the reactant fluid or between two inks reactive with one another; and, black, cyan, magenta, and yellow will be used to refer to the first through fourth inks. Furthermore, the term "image integrity" will encompass print attributes such as bleed alleviation, reduced dry time, smearfastness, and waterfastness that may be affected as the result of the reaction between two reactive fluids. Additionally, when referring to an ink reactive with the reactant fluid, the ink may be reactive or non-reactive, with another ink.

By way of example, FIG. 1, represents an ink-jet printing system employing five different reservoir chambers 120K, 120C, 120M, and 120Y, for housing four different inks, first through fourth inks; and 120F for housing reactant fluid F, respectively, in which the reactant fluid is reactive with at least one of ink. In one embodiment, the reactant fluid and the at least one ink reactive with the reactant fluid are utilized in an integral printhead portion. In another embodiment, the fluid set further comprises an ink non-reactive with the reactant. In the embodiment employing an integral printhead, the fluid set, preferably, includes an ink non-reactive with the reactant fluid. In a preferred embodiment, the reactant fluid and the at least one ink reactive with the reactant fluid are utilized in an integral printhead portion. In a preferred embodiment the reactant fluid is reactive with at least one of the black, cyan, and magenta inks, more preferably with black, cyan, and magenta inks, and non-reactive with the yellow ink. In one embodiment, in addition to the reactant fluid being reactive with at least one ink and non-reactive with at least one ink, at least two of the inks are reactive with one another (otherwise referred to as "mutually reactive inks"), for example, the black ink is reactive with at least the magenta ink or the yellow ink, and preferably, with both the magenta and the yellow inks; and more preferably, the cyan ink is non-reactive with the black ink. It should be appreciated by those skilled in the art, that the present invention is not limited to a fixed number of inks and reactant fluids and that more or less fluids, the fluids having same or different compositions, may be used in the fluid set.

In one embodiment the inks are non-reactive with one another but are reactive with the reactant fluid with the exception of the ink that is associated with the drop ejector portion positioned adjacent the drop ejector portion associated with the reactant fluid, the exceptional ink being non-reactive also with the reactant fluid.

It is not uncommon for fluids (including inks and reactant fluids) to puddle on the nozzle plate of the ink-jet printhead. This puddling, in turn, may lead to the mixing of the fluids, for example during the wiping process. This mixing of the fluids, especially when reactive fluids are used in association with an integral printhead may result in reliability problems in the firing chambers. Therefore, when using reactive fluid approaches (regardless of whether the reaction is between two inks or between an ink and the reactant fluid), such as those described above (or any other reactive approach for that matter), it is preferable to separate the ejector portions associated with the fluids that are reactive with one another (i.e., mutually reactive fluids). Thus, it is preferred that the mutually reactive fluids are separated by at least one ejector portion associated with a fluid non-reactive with the mutually reactive fluids to provide a separation buffer between the mutually reactive fluids. In other words, in an integral printhead configuration, no two mutually reactive fluids are associated with ejector portions that are adjacent one another. This preference for separation of adjacent ejector portions associated with mutually reactive inks, is existent in all embodiments to be described in the remainder of the description of the present invention. In a preferred embodiment, the reactant fluid is non-reactive with at least one ink associated with the ejector portion which is adjacent the ejector portion associated with the reactant fluid. In one embodiment, the reactant fluid and the at least one ink non-reactive with the reactant fluid are contained in an integral reservoir portion. In another embodiment, the reactant fluid and the at least one ink non-reactive with the reactant fluid are utilized in an integral printhead portion. In one preferred embodiment, the reactant fluid is non-reactive with the fourth ink; the first ink is mutually reactive with the third ink, and preferably, with both the third and fourth inks; and the first ink is non-reactive with the second ink. In one preferred embodiment the first, second, third, and fourth, inks are black, cyan, magenta, and yellow, respectively.

The reaction between mutually reactive fluids may employ any one of mechanisms well-known in the art such as the use of a pH-sensitive colorant, or the use of a precipitating agent, as described in the aforementioned patents and applications. The present invention can be employed in any reactive system, regardless of the purpose for the reaction, where the reactant fluid is reactive with at least one ink, and in addition, also when at least two of the inks are reactive with one another such as when the first ink is designed to be reactive with the third, and optionally, the fourth inks. The one or more reactions can serve to enhance any one of a number of desired image integrity attributes. Furthermore, the reaction scheme, between any two fluids reactive with one another (e.g., fluids one and two) may be the same or different than reaction schemes between any other two reactive fluids (e.g., fluids three and four or, fluids one and four) including reactions between inks and between reactant fluid and an ink; and each reaction scheme may comprise one or more reaction mechanisms (e.g., multivalent metal salts, cross-linking reaction).

Fluid sets employing the present invention will enhance image integrity (e.g., bleed) between adjacently printed areas where one of the adjacent areas is printed, at least partially, with at least one first reactive fluid and the other area is printed with at least another second reactive fluid reactive with the first fluid; or in an alternate embodiment, one of the adjacent areas printed (or to be printed) with an ink reactive with the reactant fluid is also printed, at least partially, with the reactant fluid, and the other print area is printed with another ink that may or may not be reactive with either of the two fluids printed on the one adjacent print area. The present fluid sets, may also enhance other image integrity attributes such as smearfastness and waterfastness where an area to be printed with an ink reactive with the reactant fluid is also printed, at least partially, with the reactant fluid, either before, after, or substantially simultaneously with, the reactive ink. In an alternate embodiment the fluid set comprises at least two mutually reactive inks. In another embodiment employing at least two mutually reactive inks, an ink non-reactive (for example the second ink) with the mutually reactive inks, can be employed such that the non-reactive ink is associated with the ejector portion located between the ejector portions associated with the two mutually reactive inks.

When an area adjacent to another print area is to be printed with an ink non-reactive with any other fluid, it is preferred that the non-reactive ink (e.g., fourth ink) has a color, preferably yellow, that will exhibit the least objectionable diffusion into its adjacently printed areas.

In descriptions stated above such as inks, reactive, non-reactive fluid arrangements; the reservoir, printhead, and print cartridge arrangements; will also be applicable to the figures below.

Figure 2:
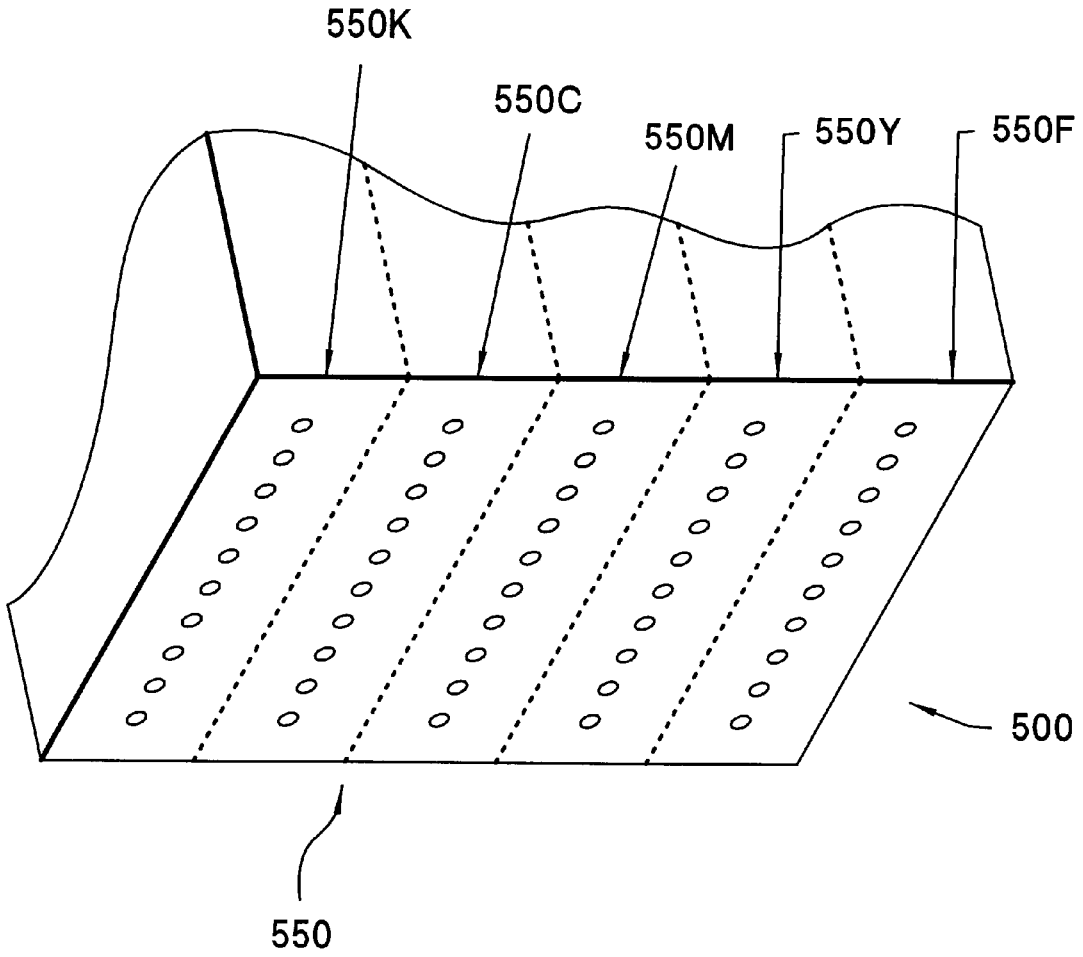
FIG. 2. is an unscaled schematic, partially sectioned, representation of an integral ink-jet printhead.
Figure 3A:
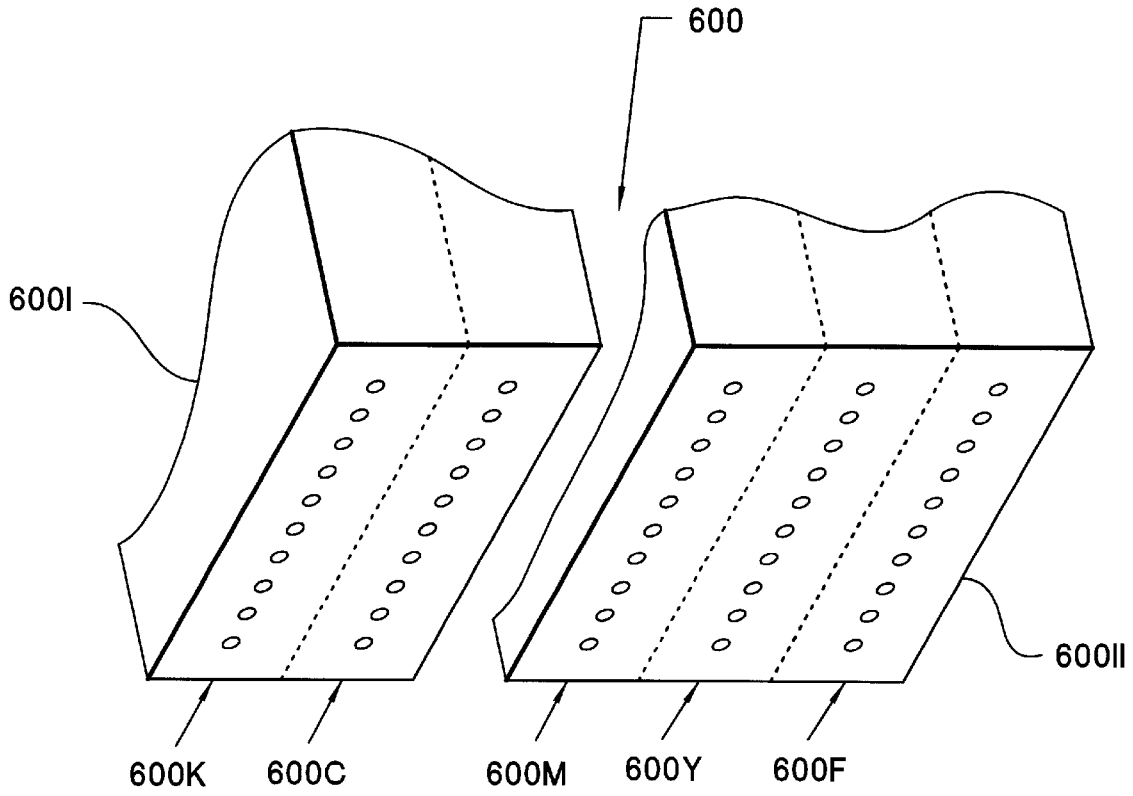
FIG. 3(*a*) is an unscaled schematic, partially sectioned, representation of an ink-jet printhead with multiple integral printheads.
Figure 3B:
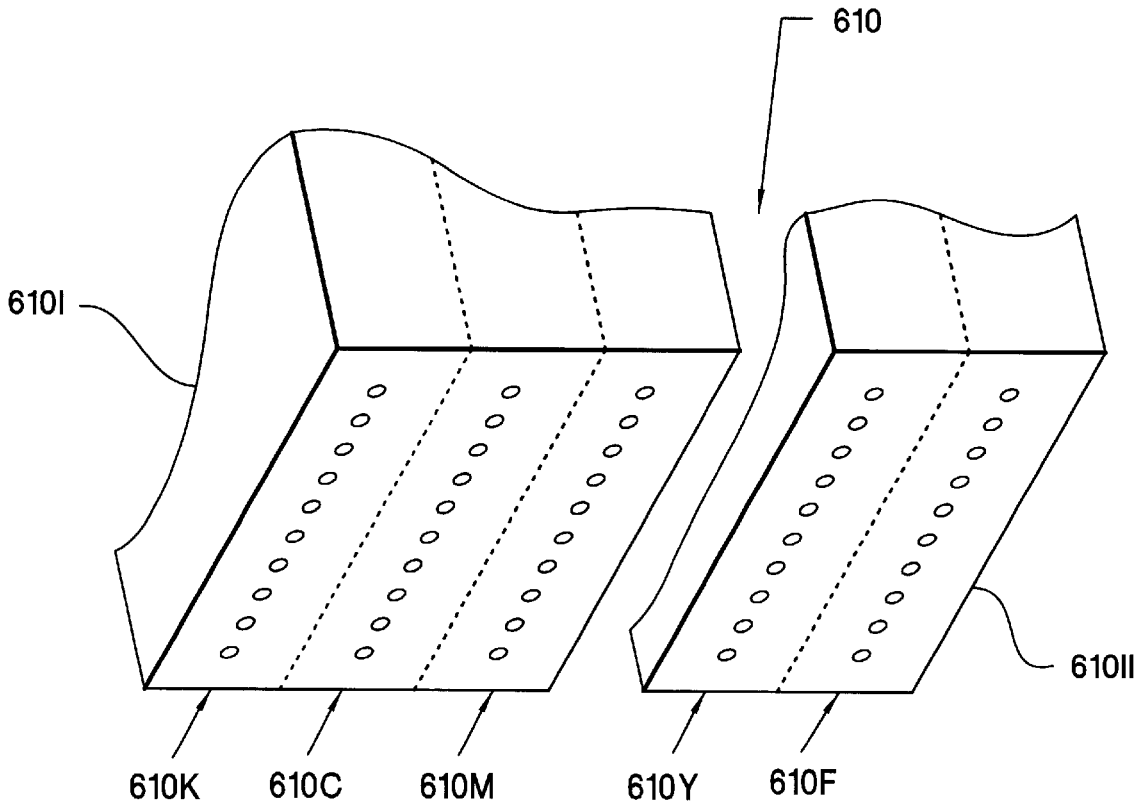
Figure 3C:
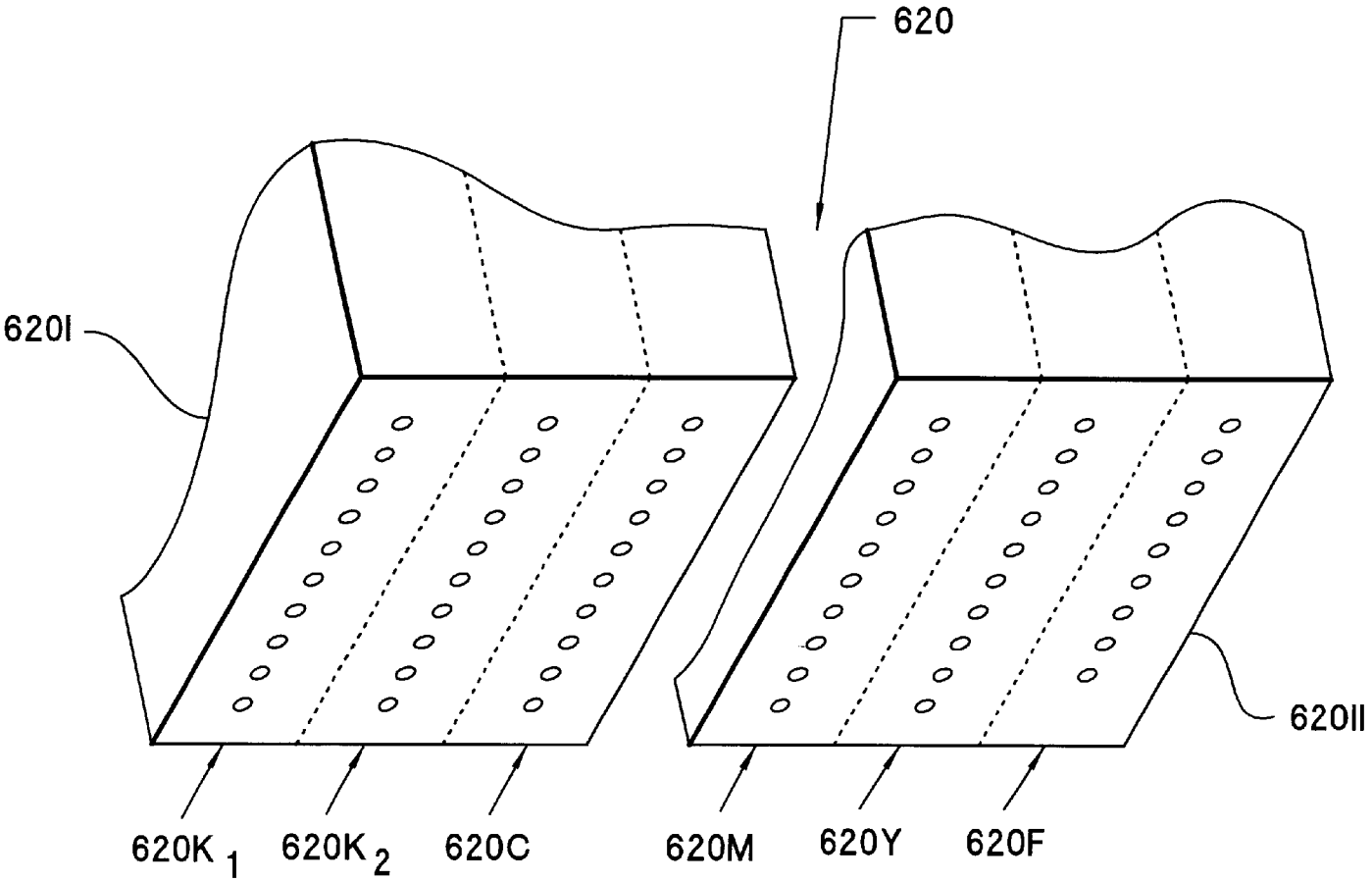
Figure 3D:
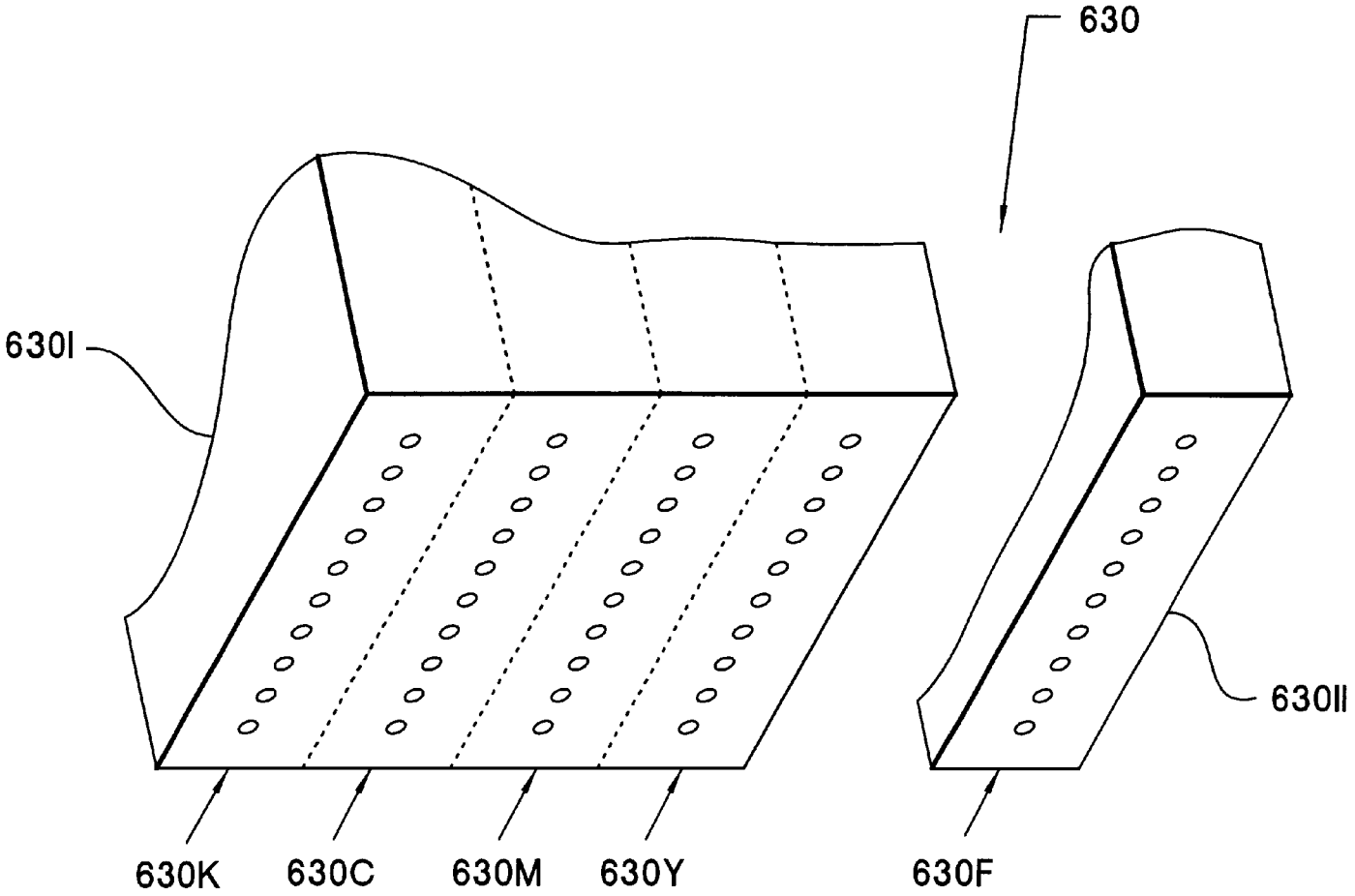
Figure 3E:
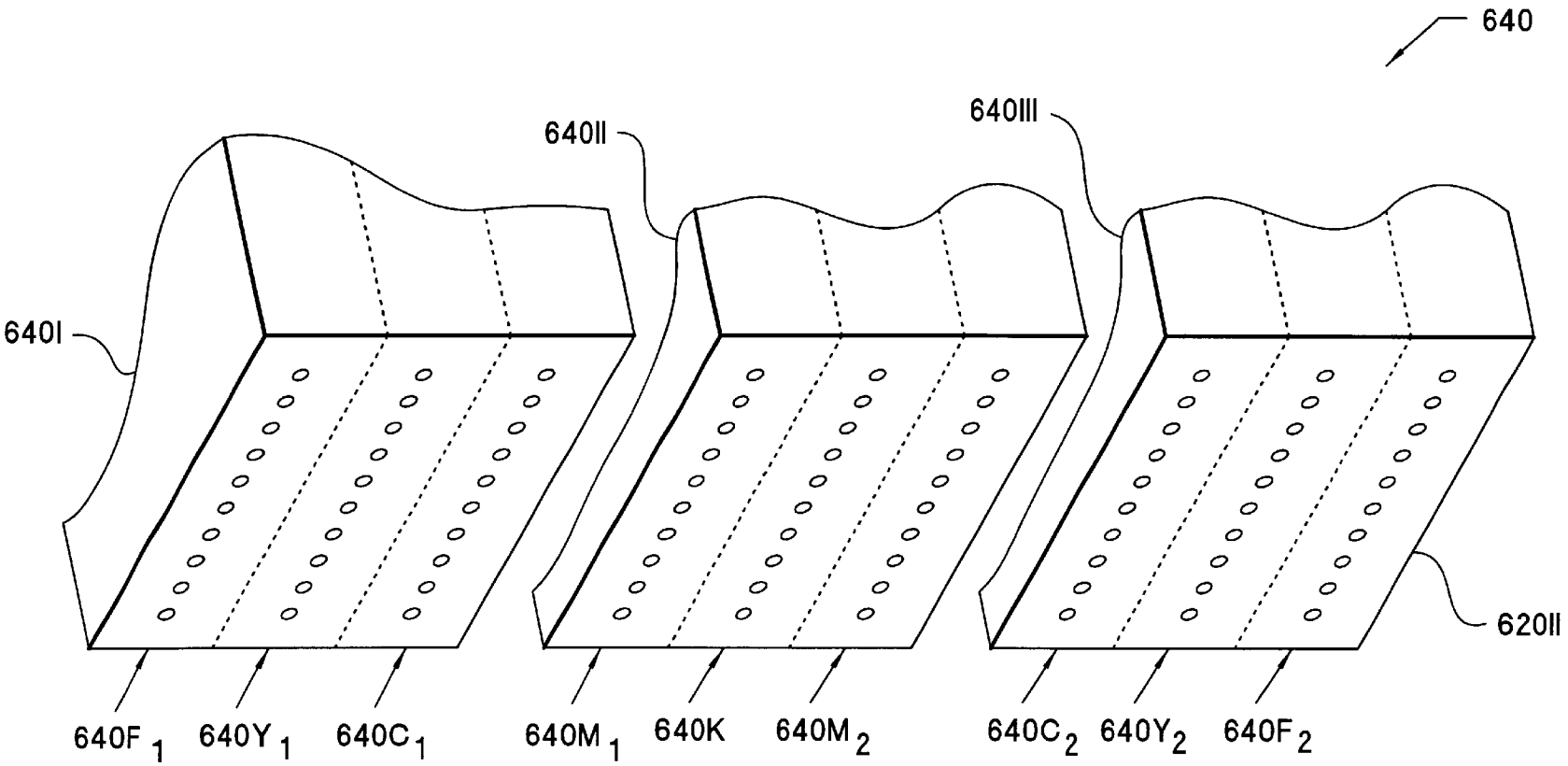

Referring now to FIG. 2, an integral printhead portion 500 comprising a plurality of ejector portions 550; 550K, 550C, 550M, and 550Y; for ejecting a plurality of inks, and 550F for ejecting a reactant fluid, is shown, broken away, with only the ejector portions illustrated. In a preferred embodiment, the plurality of inks include black, cyan, magenta, and yellow inks. Each ejector portion in printhead portion 500 includes at least one row of nozzles or orifi for ejecting a fluid associated with the ejector portion, and preferably arranged along a paper axis "P," perpendicular to the scan axis "S." The reactant fluid is reactive with at least one of the inks, and preferably non-reactive with the ink associated with the ejector portion adjacent the ejector portion associated with the reactant fluid. In an alternate embodiment at least two of the inks, for example, first and third inks, are mutually reactive. In a preferred embodiment, the first ink is black.

Referring now to FIG. 3(*a*), printhead portion 600 has been divided into two integral printheads 600I and 600II. In a preferred embodiment, printhead 6001 comprises ejector portions 600K and 600C, and printhead 600II comprises ejector portions 600M, 600Y, and 600F. Each of the ejector portions, such as 600K, may comprise one or more corresponding ejector portions (e.g., for example, there may be two ejector portions associated with a fluid, such as black ink, the association being with one or more reservoir chambers). In one embodiment, ejector portions 600K and 600C are associated with black and cyan inks, and ejector portions 600M, 600Y, and 600F are associate with magenta and yellow inks and reactant fluid, respectively, wherein the magenta and the yellow inks are reactive with the black ink, and the cyan ink is non-reactive with the black ink, and preferably, the yellow ink is non-reactive with both the reactant fluid and the magenta ink.

Referring now to FIG. 3(*b*), printhead portion 610 has been divided into two integral printheads 610I and 610II. In a preferred embodiment, printhead 610I comprises ejector portions 610K, 610C, and 610M; and printhead 610II comprises ejector portions 610Y, and 610F. In one embodiment, ejector portions 610K, 610C, and 610M are associated with black, cyan, and magenta inks; and ejector portions 610Y, and 610F are associate with yellow ink and reactant fluid, respectively, wherein the magenta and the yellow inks are reactive with the black ink and the cyan ink is non-reactive with the black and magenta inks.

Referring now to FIG. 3(*c*), printhead portion 620 has been divided into two integral printheads 620I and 620II. In a preferred embodiment, printhead 620I comprises ejector portions 620$K_1$, 620$K_2$, and 620C; and printhead 620II comprises ejector portions 620M, 620Y, and 620F. As can be noted, more than one ejector portion, e.g., 620$K_1$ and 620 $K_2$, are associated with a single fluid, e.g., black ink. In one embodiment, ejector portions 620$K_1$, 620 $K_2$, are associated with black ink, and 620C is associated with, cyan ink; and ejector portions 620M, 620Y, and 620F are associated with magenta and yellow inks and reactant fluid, respectively, wherein the magenta and the yellow inks are reactive with the black ink and the cyan ink is non-reactive with the black ink.

Referring now to FIG. 3(*d*), printhead portion 630 has been divided into two integral printheads 630I and 630II. In a preferred embodiment, printhead 630I comprises ejector portions 630K, 630C, 630M, and 630Y; and printhead 630II comprises ejector portion 630F. In one embodiment, ejector portions 630K, 630C, 630M, and 630Y are associated with black, cyan, magenta, and yellow inks; and ejector portion 630F is associated with reactant fluid, respectively, wherein the magenta and the yellow inks are reactive with the black ink and the cyan ink is non-reactive with the black ink. In another embodiment the inks are non-reactive with one another but are reactive with the reactant fluid.

Referring now to FIG. 3(*e*), printhead portion 640 has been divided into three integral printheads 640I, 640II, and 640III In a preferred embodiment, printhead 640I comprises ejector portions 640$F_1$, 640$Y_1$, and 640$C_1$; printhead 640II comprises ejector portions 640$M_1$, 640K, and 640$M_2$; and printhead 640III comprises ejector portions 640$C_2$, 640$Y_2$, and 640$F_2$. In one embodiment, ejector portions 640K, 640$C_1$ and 640$C_2$, 640$M_1$ and 640$M_2$, and 640$Y_1$ and 640$Y_2$ are associated with black, cyan, magenta, and yellow inks; and ejector portions 640$F_1$ and 640$F_2$ are associated with reactant fluid; respectively. In one embodiment, the cyan and the yellow inks are reactive with the black ink and the magenta ink is non-reactive with the black ink.

Figure 4:
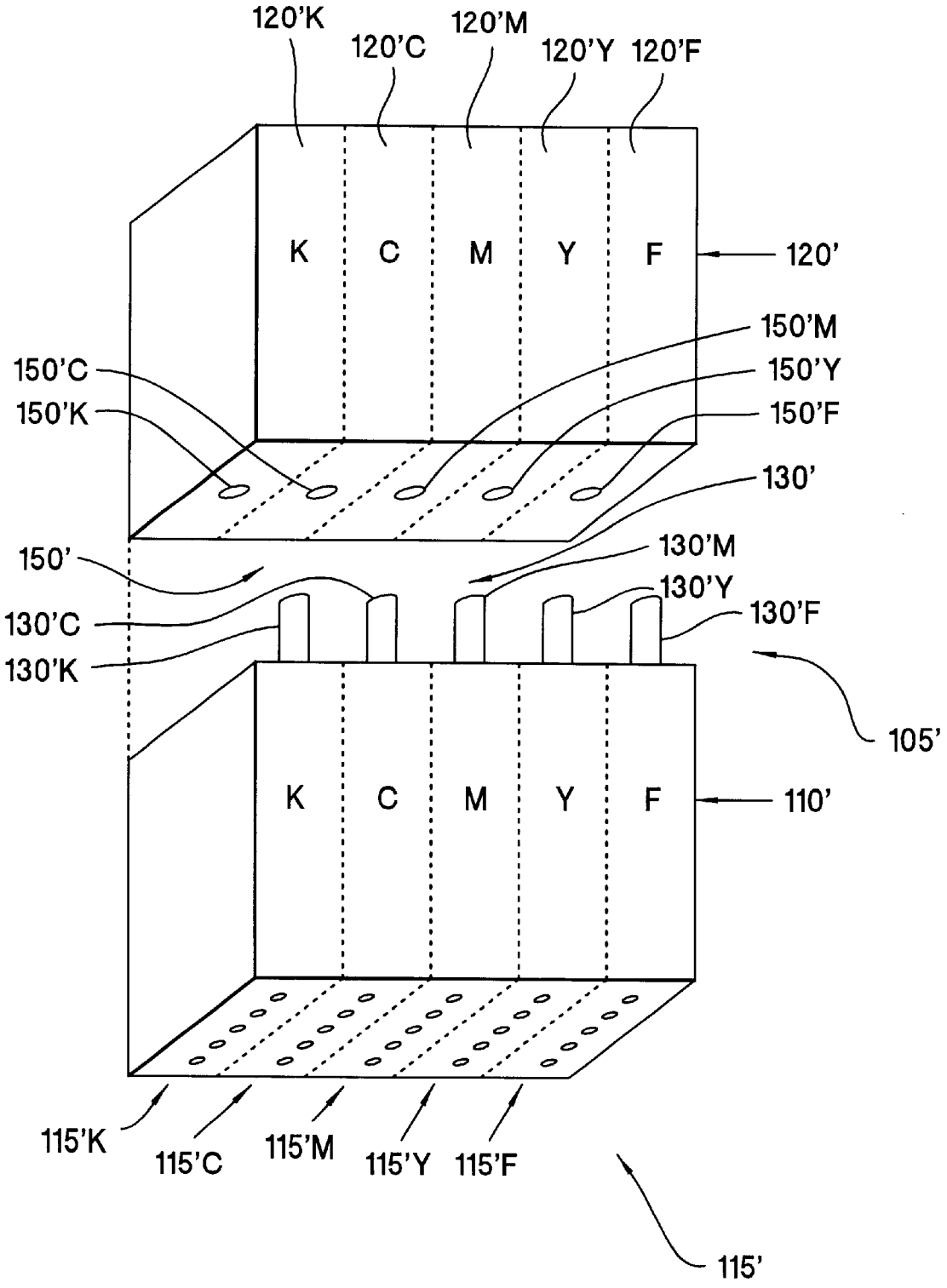
FIG. 4 is an unscaled schematic representation of an on-board fluid delivery system where the fluid reservoir is separately replaceable from the printhead.

Referring now to FIG. 4, one embodiment of ink delivery system 105' is shown in schematic form. Ink delivery system 105' includes a printhead portion 110' comprising a plurality of ejector portions 115' for ejecting different fluids, and a reservoir portion 120' for supplying fluids to the printhead portion 110' by way of fluid outlets 150' and fluid inlets 130'. When each fluid outlet 150' is connected to each fluid inlet 130', it forms a fluidic connection that fluidically couples a reservoir chamber having a particular fluid with a corresponding ejector portion in a printhead portion utilizing the same fluid.

In a preferred embodiments, fluid outlets 150' include 150'K, 150'C, 150'M, 150'Y, and 150'F are configured to connect to fluid inlets 130'K, 130'C, 130'M, 130'Y, and 130'F respectively, hence providing black, cyan, magenta, and yellow inks, and reactant fluid from their corresponding fluid reservoir chambers 120'K, 120'C, 120'M, 120'Y, and reactant fluid reservoir chamber 120'F; to ejector portions 115'K, 115'C, 115'M, 115'Y, and 115'F respectively.

In a preferred embodiment, for compactness of design, fluid outlets 150, fluid inlets 130', reservoir chambers 120', and ejector portions 115' are arranged along an array axis that is preferably parallel to the scan axis "S."

The reactant fluid is reactive with at least one ink, preferably with three inks. In one embodiment, at least two of the inks are mutually reactive. In a preferred embodiment, the first ink is black. Preferably, the first ink is mutually reactive with the third ink, and preferably with both the third and fourth inks; and non-reactive with the second ink; and the reactant fluid is non-reactive with the fourth ink. In the preferred embodiment the first, second, third, and fourth, inks are black, cyan, magenta, and yellow.

In a preferred embodiment, the reservoir chambers 120'K, 120'C, 120'M; and 120'Y and their corresponding fluid outlets 150'K, 150'C, 150'M, 150'Y, and 150'F are positioned along the scan axis "S," in a predetermined positioning order same as that for their corresponding ejector portions 115'K, 115'C, 115'M, 115'Y, and 115'F; and their corresponding fluid inlets 130'K, 130'C, 130'M, 130'Y, and 130'F; respectively. This similar positioning order, as depicted in FIG. 4, provides for maximum distance between the fluidic connections connecting the fluids reactive with one another, hence minimizing unwanted contamination between mutually reactive fluids, particularly in the event of possible leakage in the fluid connections.

Figure 5:
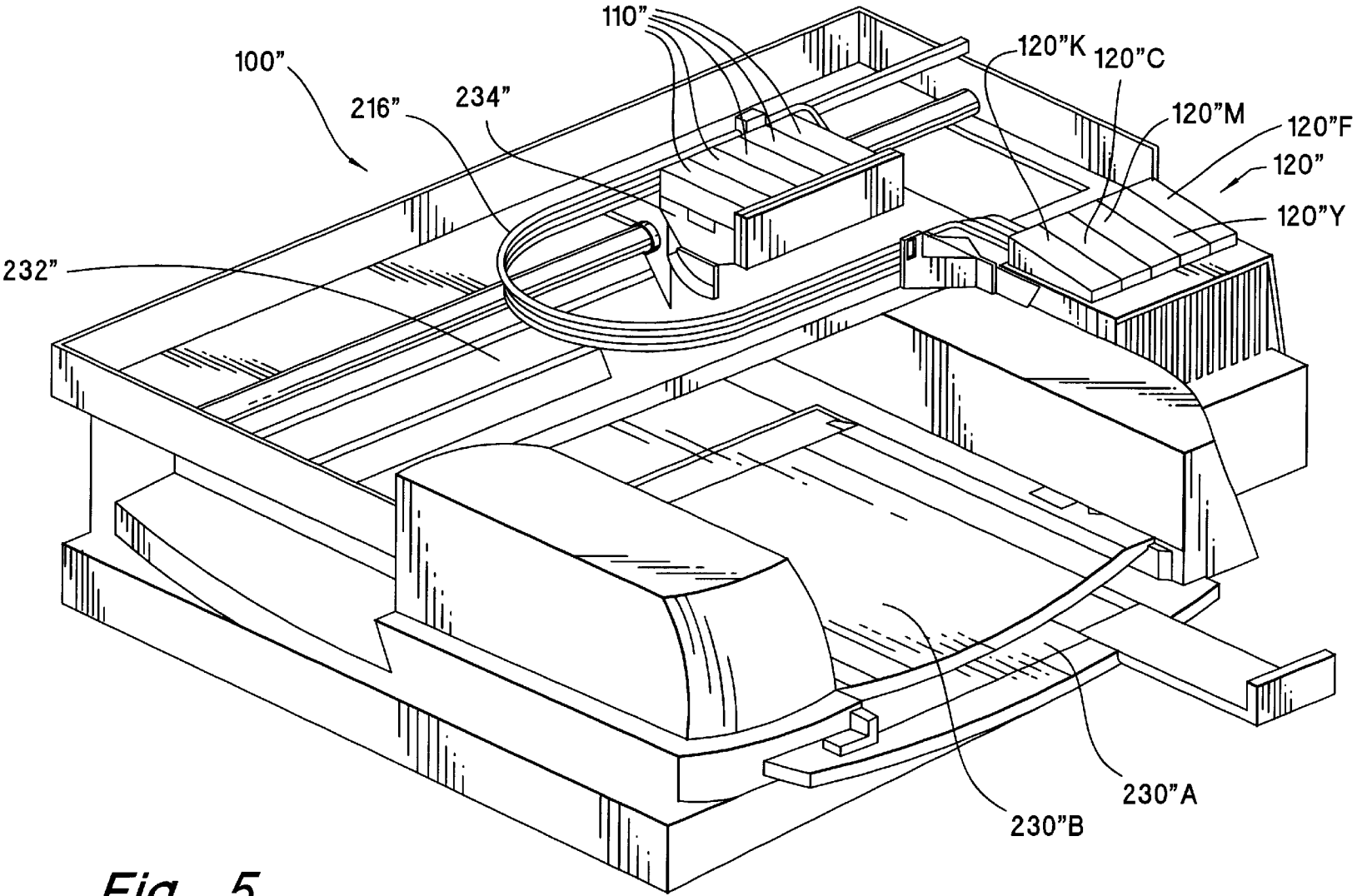
FIG. 5 is an unscaled schematic representation of an off-board fluid delivery system where the fluid reservoir is connected to the printhead via a fluid conduit.

FIG. 5 depicts a representation of one embodiment of printing system 100". Printing system 100" includes printing medium input 230"A and output 230"B trays for storing printing medium (not shown) both before and after, respectively, the printing medium is fed through a print zone 232". A carriage 234" supports a printhead portion 110" and scans over print zone 232" in a scan direction "S" to allow the ejectors portions (not shown) associated with printhead portions 110" to selectively deposit one or more fluids on the printing medium. The printhead portion 110" is fluidically connected to a reservoir portion 120" via conduit 216". The reservoir portion 120" may be placed in a location that scans with the carriage 234" or in a location that does not, to allow for varying carriage configurations. In the embodiment depicted in FIG. 5, printhead portion 110" comprising five ejector portions 115"K, 115"C, 115"M, 115"Y, and 115"F (not shown); is spaced from the reservoir portion 120" comprising five reservoir chambers 120"K, 120"C, 120"M, 120"Y, and 120"F; to allow the reservoir portion 120" to be placed in a location that does not scan with carriage 234". Printhead portion 110" receives ink and reactant fluid from reservoir portions 120" via conduit 216".

It should be appreciated by those skilled in the art that the number and color of inks and reactant fluid in the fluid set is not limited to the examples above and that more or less number of inks having the same or different colors may be employed. It should further be appreciated that the designation of first through fourth inks is not limited to black, cyan, magenta, and yellow and also that when a non-reactive subset is used any one of the inks may define the non-reactive subset. By way of example, the ink set could comprise: black, $cyan_1$, $cyan_2$, $magenta_1$, $magent_2$, and yellow, wherein the designations "1" and "2" refer to inks having the same hue but a different colorant concentrations or the same ink formulation; or black, cyan, magenta, yellow, red, green, blue, and white to provide a larger color gamut. Furthermore, the reactant fluid reservoir and its corresponding ejector portion may be placed at any one or more locations consistent with the present invention, for example on either or both sides of the inks as for example illustrated by the configuration depicted in FIG. 3(*e*). Consistent with the present invention, preferably, any two fluids associated with adjacently located ejector portions are non-reactive with one another.

Fluids

The present fluid set comprises at least one reactant fluid and at least one ink reactive with the reactant fluid, and preferably, at least one ink non-reactive with the reactant fluid. The fluids comprise an aqueous vehicle. The inks further comprise at lease one colorant. The reactant fluid further comprises at least one component for reacting with at least one component in the at least one ink with which the reactant fluid is reactive. At least one ink, preferably all, and most preferably, all but one, is reactive with the reactant fluid. In one embodiment, at least two of the inks are also mutually reactive with one another (e.g., first and third inks). In another embodiment, the ink set comprises at least one ink non-reactive (e.g., second ink) with the at least two mutually reactive inks.

The reaction between the reactive fluids may employ any one of reactive mechanisms well-known in the art such as the use of a pH-sensitive colorant, or the use of a precipitating agent, as described in the aforementioned patents and applications. The present invention can be employed in any reactive system when the reactant fluid is reactive with at least one ink. As stated earlier, the reaction between the reactive fluids can serve to enhance any one of a number of print system attributes such as bleed alleviation, smearfastness, reduced dry time, or any other desirable attribute. Furthermore, the reaction scheme, between any two reactive fluids (e.g., fluid one and fluid two) may be the same or different than reaction schemes between any other two reactive fluids (e.g., fluid three and fluid four or, fluid one and fluid four); and each reaction scheme may comprise one or more reaction mechanisms, such as those disclosed in U.S. patent application Ser. No. 09/064,643, entitled "Ink Set For Improved Print Quality," by Ma et. al., filed Apr. 22, 1998 now U.S. Pat. No. 6,022,908, and assigned to the same assignee as the present invention, and incorporated herein by reference in its entirety.

Aqueous Vehicle

The aqueous vehicle is water or a mixture of water and at least one water-soluble organic solvent, as is well-known in the art. Selection of a suitable mixture depends on requirements of the specific application, such as the desired surface tension and viscosity, the selected colorant, drying time of the ink-jet fluid, and the type of print medium onto which the fluid will be printed.

Reactive Components

Depending on the reaction mechanism employed, the reactive fluids may have additional components. For example, when the reaction mechanism for reducing bleed is by precipitation of a pH-sensitive colorant in the first ink, either or both the reactant fluid and the reactive third and fourth inks comprise an organic acid in sufficient amount to render the pH-sensitive colorant of the first ink insoluble upon contact, as disclosed in U.S. Pat. No. 5,679,143 and U.S. application Ser. No. 08/567,974 now U.S. Pat. No. 5,785,743, mentioned above. Similarly, when the reaction mechanism is based on the use of a precipitating agent, such as multi-valent metal salts, as disclosed in the aforementioned patents, either or both the reactant fluid and the third and fourth inks contain a precipitating agent, e.g., multi-valent metal salt.

Alternatively, when there are multiple reaction schemes, as for example, those disclosed in Ma, all desired reactive components compatible with one another in a given fluid composition may be present in the reactant fluid and any other reactive ink. For example, Ma discloses, a set of printing liquids comprising: a first anionic printing liquid comprising an aqueous vehicle, at least one first colorant, and at least one first anionic polymer; a second anionic printing liquid comprising an aqueous vehicle, at least one second colorant, at least one second anionic polymer, and an acid additive having a pKa up to the pKa of the at least first polymer of the first printing liquid; a third cationic printing liquid comprising an aqueous vehicle, at least one third colorant, at least one third cationic polymer, and a pH in the range from about 2 to about 5; and a fourth anionic printing liquid comprising an aqueous vehicle, at least one fourth anionic dye, and a precipitating agent. By way of example and without limiting the scope of the present invention, Ma provides the following ink set and reaction schemes:

Carbon black pigment is used as the colorant in the first ink. The carbon black pigment in the first ink, black (K), is stabilized by a carboxylated polymeric dispersant (anionic) and the ink has a pH of about 8.

The magenta pigment in the second ink, magenta (M), is stabilized by a sulfonated or phosphonated polymeric dispersant (anionic). The magenta ink has a carboxylic acid additive and a pH of about 3.

The yellow pigment in the third ink, yellow (Y), is stabilized by a cationic polymeric dispersant, and the ink has a pH of about 3.

The cyan colorant in the fourth ink, cyan (C), is an anionic water-soluble dye. The cyan ink further contains a precipitating agent, here a multivalent metal salt, and optionally a carboxylic acid additive. The ink has a pH of about 3.

The reaction between the black and magenta inks is caused by the pH difference between the two inks and the excess hydrogen ions from the magenta ink. The black ink and the yellow ink react by virtue of the opposite charge between the dispersants for the black and the yellow pigments. The black ink and the cyan ink react due to the precipitation of the dispersed black pigment by the multi-valent metal ions (precipitating agent). Additionally, when the fourth ink (e.g., cyan) contains the optional acid, the pH difference between the cyan and the black ink further enhances the precipitation of the colorant in the black ink.

The reaction between the magenta and the yellow inks is caused by the opposite charge between the dispersants for the magenta and the yellow pigments. The magenta and the cyan inks react by virtue of the multivalent metal precipitating the dispersed magenta pigment.

And, finally, the yellow ink and the cyan ink react due to the opposite charge between the dispersed yellow pigment and the cyan dye.

In the present invention, the reactant fluid may contain all of the aforementioned reactive components compatible with one another so as to provide for the proper reaction mechanisms between the reactant fluid and an ink reactive with the reactant fluid or between two inks reactive with one another. It is also within the scope of the present invention to have a fluid set wherein the reactant fluid may have to react with more than one ink to achieve the desired (that is, the reactant fluid may provide a component such that in the event that the reactant fluid and two inks come into contact with one another on a print medium a desirable reaction occurs).

Furthermore, the reactant fluid may contain polymeric or cross-linkable components for Tendering the images more permanent. For example, the reactive fluids (e.g., the reactant fluid and an ink reactive with the reactant fluid) may each contain a component that will react with the component in the other reactive fluid such that upon reacting it will render the printed image more permanent.

Colorants

The colorants may be dye-based or pigment-based. As used herein, the term "pigment" refers to a colorant that is insoluble in the aqueous vehicle, and includes disperse dyes as well has pigments that are either dispersed with the aid of a dispersant or those that are self-dispersed.

The colorants employed in the inks may be either dye or pigment-based. The choice of colorants is dependent upon the particular printing application. As in the case of the colorant for the first ink, the choice of colorant further depends on the reaction mechanism of choice, for example—use of pH sensitive colorant, or the use of a precipitating agent (e.g., multi-valent metal salt), or any other suitable reaction mechanism.

Examples of suitable colorants used in the first ink include organic dyes having at least one and preferably two or more carboxyl and/or carboxylate groups examples of which are listed in U.S. Pat. No. 4,963,189 (filed by Hindagolla and assigned to the same assignee as the present invention, and incorporated herein by reference), and carboxylated pigment dispersions having a water insoluble colorant (e.g., pigment) dispersed with a dispersant preferably containing carboxylate solubilizing groups, such as those disclosed in U.S. Pat. Nos. 5,085,698, and 5,555,008, both incorporated herein by reference; or self-dispersed pigments provided under the Trade name Cabojet™ by Cabot Company.

Colorants for use in the other inks, i.e., second, third, and fourth inks, are well-known in the art, and for example, as described in the aforementioned patents and applications.

Additional Components

The fluids may further comprise additional components such as biocides, surfactants, and the like, each of which are commonly employed additives in ink-jet printing.

Printing Method

Fluid sets employing the present invention will enhance image integrity (e.g., bleed) between adjacently printed areas where one of the adjacent areas is printed, at least partially, with at least one reactive fluid and the other adjacent area is printed, at least partially, with at least another fluid reactive with the at least one reactive fluid. The present fluid sets, may also enhance image integrity (e.g., smearfastness and waterfastness) where an area to be printed with a reactive ink is also printed, at least partially, with the reactant fluid, either before, after, or substantially simultaneously with, the reactive ink.

The printing method comprises:

providing an ink-jet fluid set, the fluid set comprising at least three fluids, the fluid set comprising at least two fluids reactive with one another wherein the at least two reactive fluids comprises at least one reactant fluid and at least one ink reactive with the reactant fluid, and at least one ink non-reactive with the reactant fluid;

selecting a first predetermined area on a print medium;

printing at least one drop of one reactive fluid on the first predetermined print area to create a first printed element;

printing at least one drop of the other reactive fluid on the print medium to create a second printed element, such that the second printed element at least partially overlaps with the first printed element, thereby causing a reaction between the at least one drop of the one reactive fluid and the other reactive fluid on the print medium, thereby enhancing a print attribute.

In another embodiment, separate from or complementary to the printing method described above, the printing method comprises:

providing an ink-jet fluid set, the fluid set comprising at least three fluids, the fluid set comprising at least two fluids reactive with one another wherein the at least two reactive fluids comprises at least one reactant fluid and at least one ink reactive with the reactant fluid, and at least one ink non-reactive with the reactant fluid;

selecting a first predetermined area on a print medium;

selecting a second predetermined print area on the print medium adjacent the first predetermined print area;

printing at least one drop of one reactive fluid on the first predetermined print area to create a first printed element;

printing at least one drop of the other reactive fluid on the print medium to create a second printed element, such that the second printed element at least partially overlaps with the first printed element, thereby causing a reaction between the at least one drop of the one reactive fluid and the other reactive fluid on the print medium;

printing at least one drop of the non-reactive ink on the second predetermined print area;

thereby minimizing the mixing of the at least one drop of the ink reactive with the reactant fluid with the at least one drop of the ink non-reactive with the reactant fluid on the print medium, thereby reducing bleed between the adjacently printed areas.

It should be appreciated by those skilled in the art, that the reaction between the reactant fluid and the ink reactive with the reactant fluid may take place regardless of the order in which droplets of the reactant fluid and the ink reactive with the reactant fluid are deposited on the print medium. For example, the reactant fluid may be deposited first, after or substantially simultaneously with the ink reactive with the reactant fluid, such as the black ink, as it may be required to achieve the desired reactive result. Similarly, the ink to be printed on the second print area may be deposited first, followed by the deposition of the reactant fluid and the ink reactive with the reactant fluid on the first print, respectively.

Industrial Applicability

The present ink-jet printing apparatus and fluid delivery apparatus are expected to find commercial use in inkjet printing.

Thus, there has been disclosed an ink-jet printing apparatus and a fluid delivery apparatus. It will be readily apparent to those skilled in the art that various changes and modifications of an obvious nature may be made without departing from the spirit of the invention, and all such changes and modifications are considered to fall within the scope of the invention as defined by the appended claims.

What is claimed is:

1. An ink-jet printing apparatus, comprising:

a least one printhead portion having at least one integral printhead portion, the printhead portion having at least three ejector portions; and at least one reservoir portion associated with the printhead portion, the reservoir portion having at least three reservoir chambers, each reservoir chamber for providing fluid to one of the at least three ejector portions, one of the reservoir chambers including a reactant fluid, the other two reservoir chambers, each chamber including an ink, wherein (1) at least one of the inks undergoes a reaction when contacted with the reactant fluid, the reaction being (a) a pH-sensitive colorant precipitating out of the ink when a certain pH range around the colorant is achieved, (b) a colorant precipitating out of the ink when the colorant binds with a precipitating agent from the reactant fluid, (c) an anionic colorant precipitating out of the ink when the colorant binds with a cationic polymeric dispersant from the reactant fluid, or (d) a cationic colorant precipitating out of the ink when the colorant binds with an anionic polymeric dispersant from the reactant fluid;

(2) at least one of the inks does not undergo a reaction when contacted with the reactant fluid, the reaction being (a) a pH-sensitive colorant precipitating out of the ink when a certain pH range around the colorant is achieved, (b) a colorant precipitating out of the ink when the colorant binds with a precipitating agent from the reactant fluid, (c) an anionic colorant precipitating out of the ink when the colorant binds with a cationic polymeric dispersant from the reactant fluid, or (d) a cationic colorant precipitating out of the ink when the colorant binds with an anionic polymeric dispersant from the reactant fluid.

2. The apparatus of claim 1 wherein the at least one integral printhead portion and the at least one reservoir portion associated with the at least one integral printhead portion form an integral print cartridge.

3. The apparatus of claim 1 wherein the at least one reservoir portion is adapted to be releasably mounted to the at least one integral printhead portion associated with the at least one reservoir portion.

4. The apparatus of claim 1 wherein the at least one printhead portion includes at least three fluid inlets, and the reservoir portion includes at least three corresponding fluid outlets configured for connection to the three fluid inlets.

5. The apparatus of claim 1 wherein the ejector portion for ejecting the ink non-reactive with the reactant fluid is positioned between the two ejector portions associated with the reactant fluid and the ink reactive with the reactant fluid.

6. The apparatus of claim 5 wherein the ejector portions for ejecting the reactant fluid and the ink non-reactive with the reactant fluid are associated with the same integral printhead.

7. The apparatus of claim 5 wherein the ejector portion for ejecting the reactant fluid is on an integral printhead different than the integral printhead having the ejector portion for ejecting the ink reactive with the reactant fluid.

8. The apparatus of claim 5, 6, or 7 further comprising at least another ink reactive with the reactant fluid.

9. The apparatus of claim 1 further comprising a scanning carriage that supports the printhead portion and provides relative motion between the printhead portion and a print media.

10. A fluid delivery apparatus for providing fluid ink-jet printing system, the fluid delivery apparatus comprising:

a reservoir portion having at least one integral reservoir portion, the reservoir portion having at least three reservoir chambers, each reservoir chamber for providing fluid to the ink-jet printing system, one of the reservoir chambers including a reactant fluid, the other two reservoir chambers each chamber including an ink, wherein (1) at least one of the inks undergoes a reaction when contacted with the reactant fluid, the reaction being (a) a pH-sensitive colorant precipitating out of the ink when a certain pH range around the colorant is achieved, (b) a colorant precipitating out of the ink when the colorant binds with a precipitating agent from the reactant fluid, (c) an anionic colorant precipitating out of the ink when the colorant binds with a cationic polymeric dispersant from the reactant fluid, or (d) a cationic colorant precipitating out of the ink when the colorant binds with an anionic polymeric dispersant from the reactant fluid and (2) at least one of the inks does not undergo a reaction when contacted with the reactant fluid, the reaction being (a) a pH-sensitive colorant precipitating out of the ink when a certain pH range around the colorant is achieved, (b) a colorant precipitating out of the ink when the colorant binds with a precipitating agent from the reactant fluid, (c) an anionic colorant precipitating out of the ink when the colorant binds with a cationic polymeric dispersant from the reactant fluid, or (d) a cationic colorant precipitating out of the ink when the colorant binds with an anionic polymeric dispersant from the reactant fluid.

11. The apparatus of claim 10 wherein the reservoir chambers form an integral reservoir portion.

12. The apparatus of claim 10 wherein the reservoir chambers containing the reactant fluid and the ink reactive with the reactant fluid form different integral reservoir portions.

13. The apparatus of claim 10 wherein the reservoir portion includes at least three fluid outlets for providing the reactant fluid, the ink reactive with the reactant fluid, and the ink non-reactive with the reactant fluid, to three fluid inlets associated with the printing system.

14. The apparatus of claim 13 wherein the fluid outlets providing the reactant fluid and the ink reactive with the reactant fluid are separated by the fluid outlet providing the ink non-reactive with the reactant fluid, thereby minimizing the unwanted mixing of the reactant fluid and the ink reactive with the reactant fluid.

15. The apparatus of claim 10 wherein the printing system further includes at least one printhead portion having at least one integral printhead portion, and wherein the reservoir portion is adapted to be releasably mountable to the printhead portion associated with the reservoir portion, to make fluids available to the printhead portion.

16. A fluid delivery apparatus for providing fluid to an ink-jet printing system, the fluid delivery apparatus comprising:

a plurality of reservoir chambers, each reservoir chamber for containing one of a plurality of fluids, the plurality of fluids including at least two mutually reactive fluids and at least one ink which does not undergo a reaction when contacted with either of the at least two mutually reactive fluids, the reaction being (a) a pH-sensitive colorant precipitating out of the ink when a certain pH range around the colorant is achieved, (b) a colorant precipitating out of the ink when the colorant binds with a precipitating agent from the reactant fluid, (c) an anionic colorant precipitating out of the ink when the colorant binds with a cationic polymeric dispersant from the reactant fluid, or (d) a cationic colorant precipitating out of the ink when the colorant binds with an anionic polymeric dispersant from the reactant fluid, and wherein one of the at least two mutually reactive fluids is an ink which undergoes a reaction when contacted with a reactant fluid and another one of the at least two mutually reactive fluids is the reactant fluid, the reaction being (a) a pH-sensitive colorant precipitating out of the ink when a certain pH range around the colorant is achieved, (b) a colorant precipitating out of the ink when the colorant binds with a precipitating agent from the reactant fluid, (c) an anionic colorant precipitating out of the ink when the colorant binds with a cationic polymeric dispersant from the reactant fluid, or (d) a cationic colorant precipitating out of the ink when the colorant binds with an anionic polymeric dispersant from the reactant fluid.

17. The apparatus of claim 16 wherein the plurality of reservoir chambers form an integral reservoir portion.

18. The apparatus of claim 16 wherein the reservoir chambers containing the reactant fluid and the ink reactive with the reactant fluid form different integral reservoir portions.

19. The apparatus of claim 16 wherein the reservoir chambers including at least the reactant fluid and the ink non-reactive with the reactant fluid for an integral reservoir portion.

20. The apparatus of claim 16 further comprising at least another ink reactive with the reactant fluid.

21. The apparatus of claim 20 wherein at least two of the inks reactive with the reactant fluid are also reactive with one another, and at least one ink reactive with the reactant fluid is non-reactive with other inks.

22. An ink-jet printing apparatus, comprising:

at least one printhead portion having at least one integral printhead portion, the printhead portion having at least two ejector portions; and at least one reservoir portion associated with the printhead portion, the reservoir portion having at least two reservoir chambers, each reservoir chamber for providing fluid to one of the at least two ejector portions, one of the chambers including a reactant fluid, and the other chamber including at least one ink which does not undergo a reaction when contacted with the reactant fluid, the reaction being (a) a pH-sensitive colorant precipitating out of the ink when a certain pH range around the colorant is achieved, (b) a colorant precipitating out of the ink when the colorant binds with a precipitating agent from the reactant fluid, (c) an anionic colorant precipitating out of the ink when the colorant binds with a cationic polymeric dispersant from the reactant fluid, or (d) a cationic colorant precipitating out of the ink when the colorant binds with an anionic polymeric dispersant from the reactant fluid.

23. The apparatus of claim 22 wherein the at least one integral printhead portion the at least one reservoir portion associated with the at least one integral printhead portion form an integral print cartridge.

24. The apparatus of claim 22 wherein the at least one reservoir portion is adapted to be releasably mounted to the at least one integral printhead portion associated with the at least one reservoir portion.

25. The apparatus of claim 22 wherein the at least one printhead portion includes at least two fluid inlets, and the reservoir portion includes at least two corresponding fluid outlets configured for connection to the two fluid inlets.

26. The apparatus of claim 22 further comprising a scanning carriage that supports the printhead portion and provides relative motion between the printhead portion and a print media.

27. A fluid delivery apparatus for providing fluid to an ink-jet printing system, the fluid delivery apparatus comprising:

a reservoir portion having at least one integral reservoir portion, the reservoir portion having at least two reservoir chambers, each reservoir chamber for providing fluid to the ink-jet printing system, one of the reservoir chambers including a reactant fluid, the other reservoir chambers including an ink which does not undergo a reaction when contacted with the reactant fluid, the reaction being (a) a pH-sensitive colorant precipitating out of the ink when a certain pH range around a colorant is achieved, (b) a colorant precipitating out of the ink when the colorant binds with a precipitating agent from the reactant fluid, (c) an anionic colorant precipitating out of the ink when the colorant binds with a cationic polymeric dispersant from the reactant fluid, or (d) a cationic colorant precipitating out of the ink when the colorant binds with an anionic polymeric dispersant from the reactant fluid.

28. The apparatus of claim 27 wherein the reservoir chambers form an integral reservoir portion.

29. The apparatus of claim 27 wherein the reservoir chambers containing the reactant fluid and the ink reactive with the reactant fluid form different integral reservoir portions.

30. The apparatus of claim 27 wherein the reservoir portion includes at least two fluid outlets for providing the reactant fluid and the ink non-reactive with the reactant fluid, to two fluid inlets associated with the printing system.

31. The apparatus of claim 27 wherein the printing system further includes at least one printhead portion having at least one integral printhead portion, and wherein the reservoir portion is adapted to be releasably mountable to the printhead portion associated with the reservoir portion, to make fluids available to the printhead portion.

32. A fluid delivery apparatus for providing fluid to an ink-jet printing system, the fluid delivery apparatus comprising:

a plurality of reservoir chambers each reservoir chamber for containing a fluid, the fluids including a reactant fluid and an ink which does not undergo a reaction when contacted with the reactant fluid, the reaction being (a) a pH-sensitive colorant precipitating out of the ink when a certain pH range around the colorant is achieved, (b) a colorant precipitating out of the ink when the colorant binds with a precipitating agent from the reactant fluid, (c) an anionic colorant precipitating out of the ink when the colorant binds with a cationic polymeric dispersant from the reactant fluid, or (d) a cationic colorant precipitating out of the ink when the colorant binds with an anionic polymeric dispersant from the reactant fluid.

33. The apparatus of claim 32 wherein the plurality of reservoir chambers form an integral reservoir portion.

* * * * *